US011230903B2

(12) United States Patent
Rochen et al.

(10) Patent No.: US 11,230,903 B2
(45) Date of Patent: Jan. 25, 2022

(54) DOWNHOLE TOOL HAVING LOW DENSITY SLIP INSERTS

(71) Applicant: Weatherford Technology Holdings, LLC, Houston, TX (US)

(72) Inventors: James A. Rochen, Waller, TX (US); Nauman H. Mhaskar, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 27 days.

(21) Appl. No.: 16/818,784

(22) Filed: Mar. 13, 2020

(65) Prior Publication Data

US 2021/0238951 A1 Aug. 5, 2021

Related U.S. Application Data

(63) Continuation of application No. 16/782,498, filed on Feb. 5, 2020, now abandoned.

(51) Int. Cl.
*E21B 33/129* (2006.01)

(52) U.S. Cl.
CPC ..... *E21B 33/1293* (2013.01); *E21B 2200/08* (2020.05)

(58) Field of Classification Search
CPC . E21B 33/129; E21B 33/1293; E21B 33/1204
See application file for complete search history.

(56) References Cited

U.S. PATENT DOCUMENTS

| | | | |
|---|---|---|---|
| 2,888,247 | A | 5/1959 | Haglund |
| 4,311,196 | A | 1/1982 | Beall et al. |
| 4,823,919 | A | 4/1989 | Hayatdavoudi |
| 5,131,468 | A | 7/1992 | Lane et al. |
| 5,271,468 | A | 12/1993 | Streich et al. |
| 5,701,950 | A | 12/1997 | Imamura et al. |
| 5,701,959 | A | 12/1997 | Yuan |
| 5,839,515 | A | 11/1998 | Yuan et al. |
| 5,984,007 | A | 11/1999 | Yuan et al. |
| 6,564,871 | B1 | 5/2003 | Roberts |
| 6,976,534 | B2 | 12/2005 | Sutton et al. |
| 7,036,397 | B2 | 5/2006 | Bangert |
| 7,124,831 | B2 | 10/2006 | Turley et al. |
| 7,407,012 | B2 | 8/2008 | Keshavan |
| 7,779,906 | B2 | 8/2010 | Porter et al. |
| 7,779,927 | B2 | 8/2010 | Turley et al. |
| 7,980,300 | B2 | 7/2011 | Roberts et al. |
| 8,047,279 | B2 | 11/2011 | Barlow et al. |

(Continued)

*Primary Examiner* — Kenneth L Thompson
(74) *Attorney, Agent, or Firm* — Blank Rome LLP

(57) ABSTRACT

A downhole tool, such as a fracture plug used during a fracture operation, installs in a downhole tubular, such as casing. The tool has a mandrel with a sealing element disposed thereon between uphole and downhole ends. Slip assemblies on the mandrel can be moved to engage the downhole tubular. The slip assemblies have inserts. The inserts have a body defining an internal cavity at least partially therein. The body is composed of a ceramic material having a first density of about 3 g/cc to about 6 g/cc. A volume of the insert can be about 0.4 cc to about 0.6 cc, and a mass of the insert can be about 1.2 g to about 3.6 g. In one example, the ceramic material is silicon nitride. The cavity can be filled with a low density filler material.

23 Claims, 5 Drawing Sheets

(56) References Cited

U.S. PATENT DOCUMENTS

| | | | | |
|---|---|---|---|---|
| 8,113,276 | B2 | 2/2012 | Greenlee et al. | |
| 9,016,364 | B2 * | 4/2015 | Chenault | E21B 33/134 166/179 |
| 9,194,206 | B2 * | 11/2015 | Xu | E21B 33/129 |
| 9,416,617 | B2 | 8/2016 | Wiese et al. | |
| 9,518,442 | B2 * | 12/2016 | Xu | E21B 33/129 |
| 9,719,316 | B2 | 5/2017 | Lemm | |
| 9,677,356 | B2 | 6/2017 | Rochen et al. | |
| 9,725,981 | B2 | 8/2017 | Young et al. | |
| 9,976,382 | B2 | 5/2018 | VanLue | |
| 10,087,707 | B2 | 10/2018 | Rochen et al. | |
| 10,415,335 | B2 | 9/2019 | Mhaskar et al. | |
| 10,683,718 | B2 * | 6/2020 | Parekh | C22C 38/06 |
| 2002/0121160 | A1 | 9/2002 | Bangert | |
| 2004/0244966 | A1 | 12/2004 | Zimmerman et al. | |
| 2005/0069691 | A1 | 3/2005 | Sutton | |
| 2007/0074873 | A1 | 4/2007 | McKeachnie et al. | |
| 2007/0119600 | A1 | 5/2007 | Slup et al. | |
| 2008/0142275 | A1 | 6/2008 | Griffin | |
| 2008/0199642 | A1 | 8/2008 | Barlow | |
| 2009/0038808 | A1 | 2/2009 | Anderson | |
| 2009/0038790 | A1 | 12/2009 | Barlow | |
| 2010/0206550 | A1 | 8/2010 | Barlow et al. | |
| 2011/0240295 | A1 | 10/2011 | Porter et al. | |
| 2012/0097384 | A1 | 4/2012 | Valencia | |
| 2012/0111556 | A1 | 5/2012 | Palmer et al. | |
| 2012/0292053 | A1 | 11/2012 | Xu et al. | |
| 2013/0020071 | A1 | 1/2013 | O'Malley | |
| 2013/0048271 | A1 | 2/2013 | VanLue | |
| 2013/0048305 | A1 | 2/2013 | Xu et al. | |
| 2014/0090831 | A1 | 4/2014 | Young | |
| 2015/0292283 | A1 | 10/2015 | Lemm | |
| 2015/0368994 | A1 * | 12/2015 | Mhaskar | E21B 23/01 166/217 |
| 2017/0044859 | A1 | 2/2017 | Blair | |
| 2018/0128073 | A1 * | 5/2018 | Frazier | E21B 33/1208 |
| 2018/0238133 | A1 | 8/2018 | Fripp et al. | |

* cited by examiner

DOWNHOLE TOOL HAVING LOW DENSITY SLIP INSERTS

BACKGROUND OF THE DISCLOSURE

Slips are used for various downhole tools, such as bridge plugs and packers. One particular type of downhole tool having slips is a composite fracture plug used in perforation and fracture operations. After the fracture operations, the composite plugs need to be drilled up (milled out) in as short of a period of time as possible and with no drill up issues. Conventional composite plugs used metallic wicker style slips, which were composed of cast iron. These metallic slips increased the metallic content of the plug and caused issues during drill up in horizontal wells, especially when coil tubing is used during the milling operation.

Due to the drawbacks of cast iron slips, composite slips typically use inserts or buttons to grip the inner wall of a casing or tubular, while reducing the issues associated with metallic slips. For example, inserts used on a non-metallic slips can be arranged and oriented as shown in FIG. 1A. The slip 20 is disposed adjacent a mandrel 10 of a downhole tool, such as a bridge plug, a packer, or the like. As shown in FIG. 1B, the slip 20 moves away from the mandrel 10 and engages against a surrounding tubular or casing wall when the slip 20 and a cone 12 are moved toward one another. Either the slip 20 is pushed against the ramped surface of the cone 12, the cone 12 is pushed under the slip 20, or both. As will be appreciated, the inserts must be able to engage with the casing to stop the tool from moving during its operation.

Typically, the inserts used for a composite slip are composed of carbide, which is a dense and heavy material. Still, the inserts also need to be easily milled up and/or removable to assist in the removal of the downhole tools from the wellbore. In any event, when the downhole tool having composite slips with inserts are milled out of the casing, the inserts tend to collect in the casing and are hard to float back to the surface. In fact, in horizontal wells, the inserts may tend to collect at the heel of the horizontal section and cause potential problems for operations. To deal with this, a gel sweep or cleanup run must be performed during the mill up operation to remove the inserts. Given that a well may have upwards of forty or fifty bridge plugs used during operations that are later milled out, a considerable number of inserts may be left in the casing and difficult to remove from downhole.

To deal with this issue, it is known to use a composite slip having inserts composed of ceramic or composed of a powdered metal, such as described in U.S. Pat. No. 9,416,617, which is incorporated herein by reference. It is also known to use a composite slip having inserts with holes or partial holes, such as disclosed in U.S. Pat. No. 9,416,617. It is further known to use a composite slip having inserts composed of different layers of material, such as described in U.S. Pat. No. 10,415,335, which is incorporated herein by reference.

Even with these solutions, operators are continually striving to reduce the amount of material left in a wellbore after milling out composite tools. To that end, the subject matter of the present disclosure is directed to overcoming, or at least reducing the effects of, one or more of the problems set forth above.

SUMMARY OF THE DISCLOSURE

In one arrangement disclosed herein, an insert is used on a slip of a downhole tool to engage in a downhole tubular.

The insert comprises a body defining an internal cavity at least partially therein. The body comprises a ceramic material having a first density of about 3 g/cc to about 6 g/cc. A volume of the insert is about 0.4 cc to about 0.6 cc, and a mass of the insert is about 1.2 g to about 3.6 g.

The body can comprise a first end configured to extend beyond a surface of the slip; and can comprise a second end configured to install in the surface of the slip. At least one of the first and second ends defines an opening to the internal cavity.

The ceramic material can be selected from the group consisting of silicon nitride (about 3.3 g/cc), alumina, aluminum oxide density (about 3.95 g/cc), zirconia, and zirconium dioxide (about 5.68 g/cc).

The insert can further comprise a filler disposed in the internal cavity. The filler can comprise a second material having a second density at least less than about 3 g/cc. For example, the second material can be selected from the group consisting of aerogel (about 0.1 to 1.0 g/cc), a dissolvable material, polyglycolide (about 1.53 g/cc), magnesium (about 1.74 g/cc), and aluminum (about 2.70 g/cc).

In one arrangement disclosed herein, an insert is used on a slip of a downhole tool to engage in a downhole tubular. The insert comprises a body and a filler. The body defines an internal cavity at least partially therein and has a first volume. The body comprises a first material having a first density. The filler is disposed in the internal cavity and has a second volume. The filler comprises a second material having a second density less than the first density.

A total volume of the insert combining the first and second volumes can be about 0.4 cc to about 0.6 cc. The first volume of the body can be about 0.4 cc to 0.5 cc, and the second volume of the filler can be about 0.1 cc to about 0.2 cc inverse to the first volume. The first density can be about 6 g/cc to about 16 g/cc, and the second density can be about 0.1 g/cc to about 6 g/cc. A mass of the insert can be about 3 g to about 9.2 g.

The first material can be selected from the group consisting of ceramic, zirconia, zirconium dioxide (about 5.68 g/cc), a metallic material, a non-metallic material, a powdered metal, iron (about 7.86 g/cc), brass (about 8.50 g/cc), cermet (about 6 to 7.5 g/cc), and tungsten carbide density (about 15.25-15.88 g/cc). Meanwhile, the second material can be selected from the group consisting of aerogel (about 0.1 to 1.0 g/cc), a dissolvable material, polyglycolide (about 1.53 g/cc), magnesium (about 1.74 g/cc), aluminum (about 2.70 g/cc), silicon nitride (about 3.3 g/cc), alumina, aluminum oxide (about 3.95 g/cc), zirconia, and zirconium dioxide (about 5.68 g/cc).

The body can define a bore therethrough as the internal cavity. The filler can fill the bore from a first end of the body to a second end of the body; or the filler can fill the bore from the first end of the body to below the second end of the body and can form a base of the insert below the second end of the body.

The body can comprise a first end enclosing the internal cavity and can have a second end being open to the internal cavity. The filler can fill the internal cavity from the first end to the second end; or the second end can define a counterbore about the internal cavity such that the filler can fill the counterbore.

The first material of the body can comprise a silicon nitride with the first density of about 3 g/cc; and the second material of the filler can have a second density at least less than 3 g/cc. The second material can be selected from the group consisting of an aerogel, a dissolvable material, polyglycolide, magnesium, and aluminum.

In one arrangement disclosed herein, a downhole apparatus for engaging in a downhole tubular comprises a mandrel, a sealing element, a first slip, and a second slip. The mandrel has a first end and a second end. The sealing element is disposed on the mandrel between the first and second ends and is compressible to engage the downhole tubular. The first slip is disposed toward the first end of the mandrel and is movable relative to the mandrel to engage the downhole tubular. The first slip has inserts. The second slip is disposed toward the second end of the mandrel and is movable relative to the mandrel to engage the downhole tubular. The second slip also has the inserts. One or more the inserts can include an insert according to any one of arrangements disclosed above.

The non-metallic material can comprise a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

The foregoing summary is not intended to summarize each potential embodiment or every aspect of the present disclosure.

DETAILED DESCRIPTION OF THE DISCLOSURE

Figure 1B:
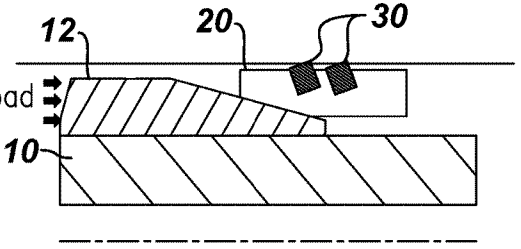
FIG. 1B (Prior Art)
FIG. 1B illustrates the slip of FIG. 1A during use.
Figure 1A:
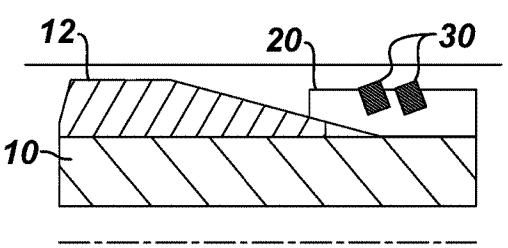
FIG. 1A (Prior Art)
FIG. 1A illustrates inserts used in a non-metallic slip according to the prior art.
Figure 2:
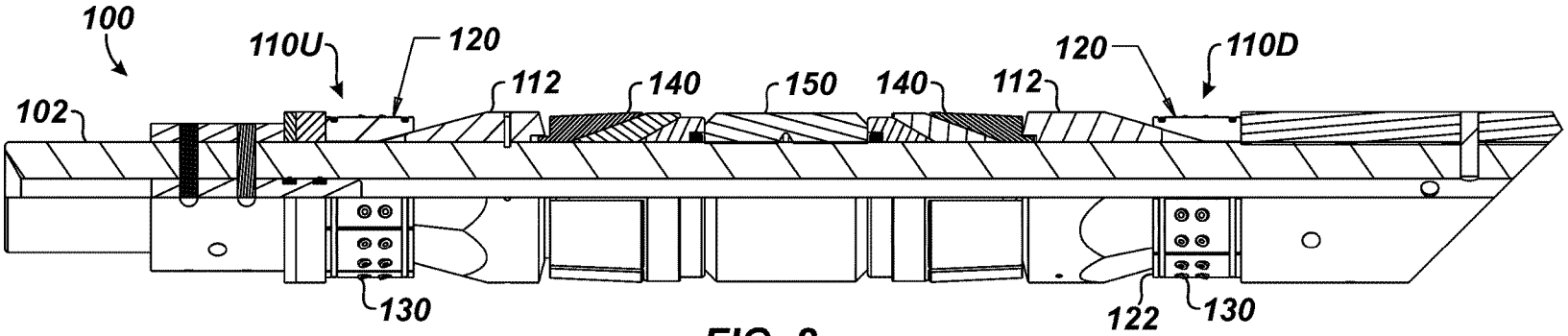
FIG. 2 illustrates a downhole tool in partial cross-section having slip assemblies according to the present disclosure.

FIG. 2 illustrates a downhole tool 100 in partial cross-section having slip assemblies 110U-D according to the present disclosure. The downhole tool 100 can be a bridge plug as shown, but it could also be a packer, a liner hanger, an anchoring device, or other downhole tool that uses a slip assembly to engage a downhole tubular, such as casing.

The tool 100 has a mandrel 102 having the slip assemblies 110U-D and backup rings 140 arranged on both sides of a packing element 150. Outside the inclined cones 112, the slip assemblies 110U-D have slips 120. Together, the slips 120 along with the cones 112 can be referred to as slip assemblies, or in other instances, just the slips 120 may be referred to as slip assemblies. In either case, either reference may be used interchangeably throughout the present disclosure. Thus, reference herein to a slip is not meant to refer only to one slip body, segment, or element, although it can. Instead, reference to slip can refer to more than just these connotations. As shown herein, slip assemblies 110U-D can have the same types of slips 120, but other arrangements could be used.

As a bridge plug, the tool 100 is preferably composed mostly of non-metallic components according to procedures and details as disclosed, for example, in U.S. Pat. No. 7,124,831, which is incorporated herein by reference in its entirety. This makes the tool 100 easy to mill out after use.

When deployed downhole, the tool 100 is activated by a wireline setting tool (not shown), which uses conventional techniques of pulling against the mandrel 102 while simultaneously pushing upper components against the slip assemblies 110U-D. As a result, the slips 120 of the slip assemblies 110U-D ride up the cones 112, the cones 112 move along the mandrel 102 toward one another, and the packing element 150 compresses and extends outward to engage a surrounding casing wall. The backup elements 140 control the extrusion of the packing element 150. In the process, the slips 120 on the assemblies 110U-D are pushed outward to engage the wall of the casing (not shown), which both maintains the tool 100 in place in the casing and keeps the packing element 150 contained.

The force used to set the tool 100 may be as high as 30,000 lbf and could be as high as 85,000 lbf. These values are only meant to be examples and could vary for the size of the tool 100. In any event, the set tool 100 isolates upper and lower portions of the casing so that fracture and other operations can be completed uphole of the tool 100, while pressure is kept from downhole locations. When used during fracture operations, for example, the tool 100 may isolate pressures of 10,000 psi or so.

As will be appreciated, any slippage or loosening of the tool 100 can compromise operations. Therefore, the slips 120 need to sufficiently grip the inside of the casing. For this reason, inserts 130 disposed on the slips 120 are used for engaging (biting into) the casing.

At the same time, however, the tool 100 and most of its components are preferably composed of millable materials because the tool 100 is milled out of the casing once operations are done, as noted previously. As many as fifty such tools 100 can be used in one well and must be milled out at the end of operations. Therefore, having reliable tools 100 composed of entirely of millable material is of particular interest to operators. To that end, the slip assemblies 110U-D of the present disclosure are particularly suited for tools 100, such as bridge plugs, packers, and other downhole tools, and the challenges they offer.

As shown in the example of FIG. 2, one type of slip 120 for the assemblies 110U-D has individual slip bodies or segments 122, which can be held around the tool's mandrel with bands. Each of the segments 122 has one or more individual inserts or buttons 130 disposed therein. In general, the segments 122 can have any number of inserts 130 arranged in one or more rows and/or one or more columns in the top surface. Each segment 122 can have the same arrangement and number of inserts 130, although different arrangements and numbers can be used. Additionally, each segment 122 can be composed of the same or different materials from the other segments 122, and each insert 130 on a given segment 122 may be composed of the same or different materials from the other inserts 130.

Figure 3B:
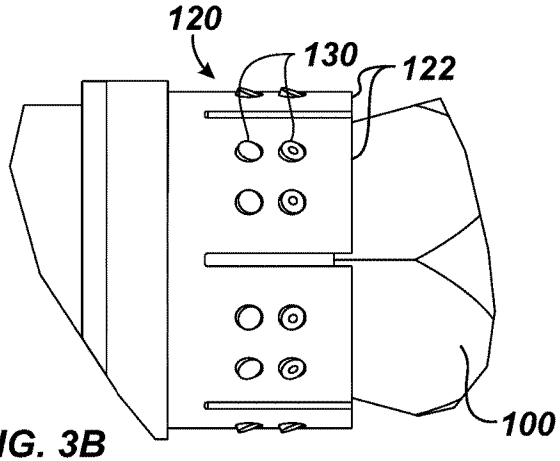
FIGS. 3A-3B illustrate detailed elevational views of other slip assemblies according to the present disclosure.
Figure 3A:
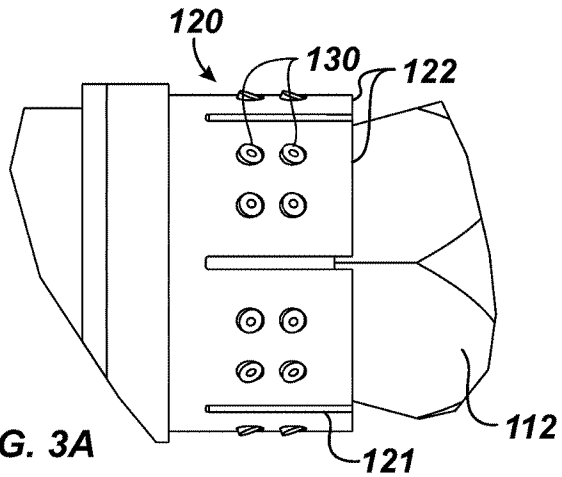

In other arrangements such as shown in FIGS. 3A-3B, the slip 120 can be a unitary ring or can be a partially integrated ring. Also as shown, the unitary ring of the slip 120 may include features 121, such as splits, divisions, scores, slots or the like, to facilitate expansion of separate pieces or segments 122 of the slip 120 when pushed against the cone 112.

In general, the slips 120 of FIGS. 2 and 3A-3B are composed of a first material, and the one or more inserts 130 are composed of second materials exposed in the body's outer surface. The first material of the slips 120 can generally be metal, composite, or the like. Preferably, the slips 120 are composed of a millable material, such as a plastic, a non-metallic material, a molded phenolic, a laminated non-metallic composite, an epoxy resin polymer with a glass fiber reinforcement, an ultra-high-molecular-weight polyethylene (UHMW), a polytetrafluroethylene (PTFE), etc.

As disclosed in more detail below, at least some of the inserts 130 of the present disclosure are composed of a ceramic material. Additionally, the inserts 130 preferably have a sufficient hardness, which may be a hardness equivalent to at least about 50-60 Rc. In a preferred embodiment, the inserts 130 of the composite plug assembly are ceramic inserts 130 installed into the slips 120 and used on the composite plug 100 as an upper and lower slip 110U-D, just a lower slip 110D, or just an upper slip 110U. Accordingly, the ceramic inserts 130 can be arranged one, the other, or both the uphole and downhole assemblies 110U-D of the tool 100. One, more, or all of the segments 122 of the assembly 110U-D can have the ceramic inserts 130.

Figure 4B:
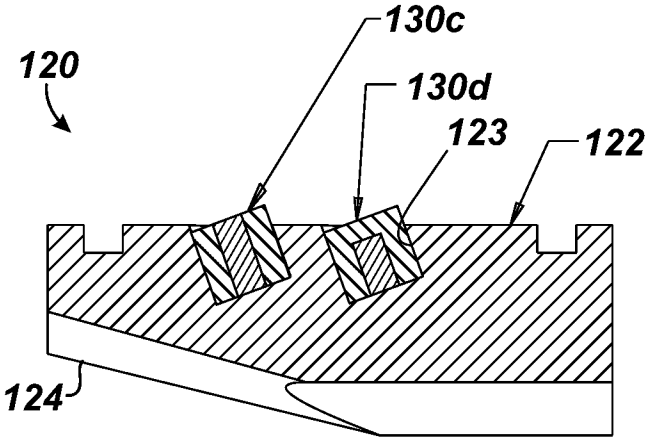
FIG. 4B illustrates a cross-sectional view of a slip having second types of inserts according to the present disclosure.
Figure 4A:
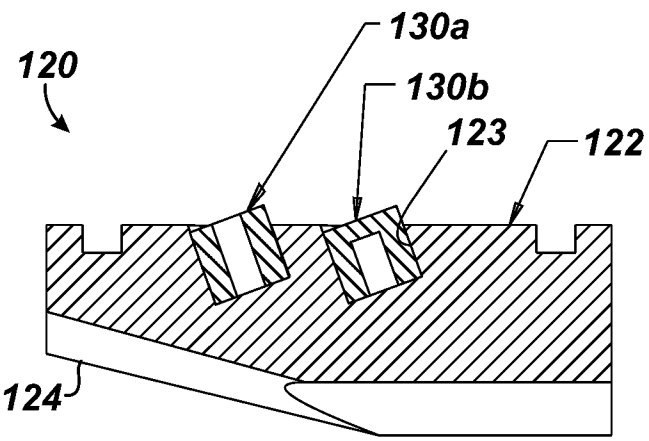
FIG. 4A illustrates a cross-sectional view of a slip having first types of inserts according to the present disclosure.

As shown in FIG. 4A, inserts 130*a-b* of a first type according to the present disclosure are disposed in holes 123 of a segment 122 relative to the segment's incline 124. The first type of insert 130*a-b* is composed of ceramic and is either hollow 130*a* or at least partially hollow 130*b*. (The different inserts 130*a-b* are shown on the same segment 122 in this example, but a given segment have any arrangement of one, the other, or both). Meanwhile, as shown in FIG. 4B, inserts 130*c-d* of a second type according to the present disclosure are disposed in holes 123 of a segment 122 relative to the segment's incline 124. The second type of insert 130*a-b* is hollow 130*c* and filled with a filler material 140 or is at least partially hollow 130*d* and filled with filler material 140. This second type of insert 130*c-d* can be composed of ceramic or other materials as disclosed herein. (Again, the different inserts 130*c-d* are shown on the same segment 122 in this example, but a given segment 122 have any arrangement of one, the other, or both. In fact, a given segment 122 can have any arrangement of the disclosed inserts 130*a-d*).

In one arrangement, the inserts 130*a-d* can be the same size and can be disposed in equivalent sized holes 123 in the slip segment 122. In another arrangement, the depth of holes 123 can vary on a given segment 122, can vary from segment 122 to segment, and can vary from slip assembly to slip assembly. Therefore, one or more inserts 130*a-d* can be longer than the others. Additionally, the height that the inserts 130*a-d* extend beyond the segment 122 can be the same on the given slip segment 122 once installed, but the depth of the holes 123 can vary. This can reduce the stress around the insert 130*a-d* in the base material of the segment 122. Other arrangements may have the inserts 130*a-d* at different heights and different depths relative to the slip segment 122.

Still further, the diameter of holes 120 for inserts 130*a-d* in the slip 120 can vary from one another on the same segment, from segment to segment, or from slip assembly to slip assembly. For example, the holes 123 toward the ramped end of the segment 122 can be narrower than the holes 123 toward the opposite end. A reverse arrangement could be used.

The shape of the inserts 130*a-d* can be the same or different from one another. In general, the inserts 130*a-d* can be cylindrical or can have other shapes as discussed below. Additionally, as shown in FIGS. 4A-4B, the different inserts 130*a-d* can be used on the same segment 122, although other arrangements are possible. Moreover, each of the segments 122 can have the same type of insert 130*a-d*, or each segment 122 can have two or more types of inserts a-d, such as hollow ceramic inserts and filled inserts according to the present disclosure. Inserts (not shown) of different material can also be used in conjunction with the disclosed inserts 130*a-d*. These and other arrangements can be used.

Figure 5B:
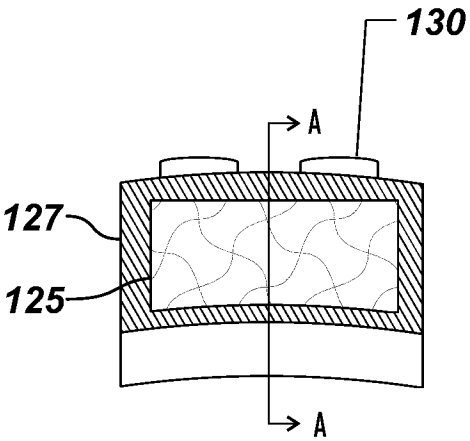
FIGS. 5A-5B illustrate a side cross-section and an end section of another type of slip according to the present disclosure.
Figure 5A:
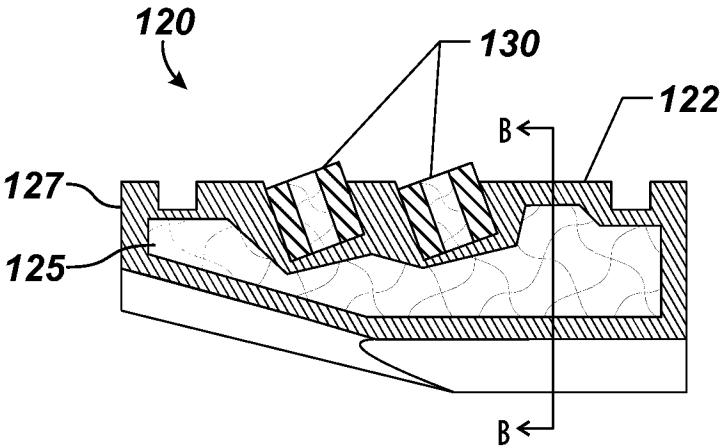

Just as the insert 130*a-d* can be hollow or partially hollow and filled with material, embodiments of the present disclosure can include slips 120 that are hollow (or partially hollow) and filled with a filler material. For example, FIGS. 5A-5B show a cross section and end section a slip 120 according to the present disclosure having an exoskeleton or shell 127 and a hollow filled with a filler material 125, as disclosed herein. The slip 120 in this instance includes a segment 122 as a hollow shell 127 filled with the filler 125. Overall, the hollow shell 127 can be composed of a millable material composed of the same material disclosed herein from slips. For its part, the filler 125 can be composed of a low density material, such as discussed below.

Figure 6A:
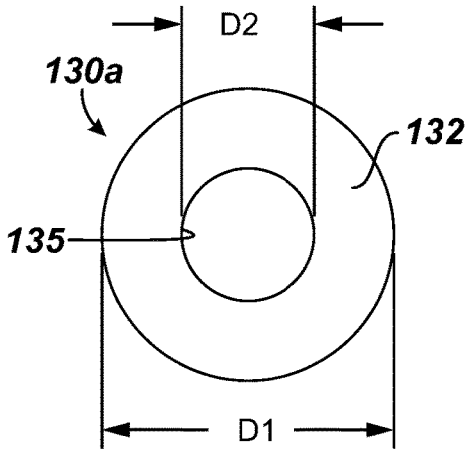
FIGS. 6A-6C illustrate top, cross-section, and perspective views of a ceramic insert with a sleeve body having a full hole.
Figure 6B:
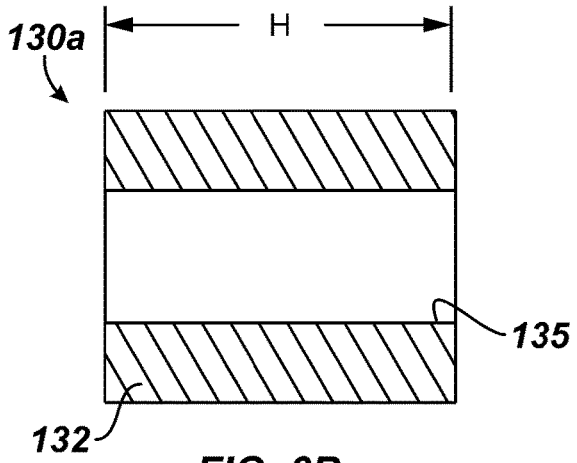
Figure 6C:
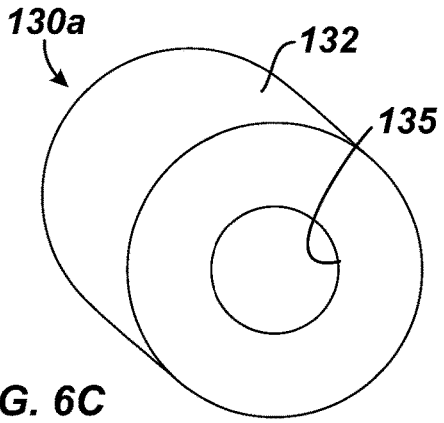

Having an understanding of the slips 120 and the types of inserts 130*a-d*, discussion now turns to particular examples of the inserts 130*a-d*. As first noted above with reference to FIG. 4A, the inserts 130*a-b* of the first type can be composed of ceramic and can include a full hole or partial hole. Accordingly, FIGS. 6A-6C illustrate an insert 130*a* for the first type that is composed of a ceramic material and is hollow. Here, this insert 130 is generally cylindrical having a first end to extend beyond a slip surface (not shown) and having a second end to install in a slip body. The insert 130*a* includes a full cavity, hole, or bore 135 therethrough so the insert 130*a* forms a hollow sleeve or body 132 composed of ceramic material. The generally cylindrical insert 130*a* can have an outer diameter D1 of about 0.3130-in. The overall height H can be about 0.375-in. The inner diameter D2 can be selected to provide the desired volume, mass, and/or density of the resulting insert. These and other dimensions discussed herein are merely meant to provide example values.

Figure 7A:
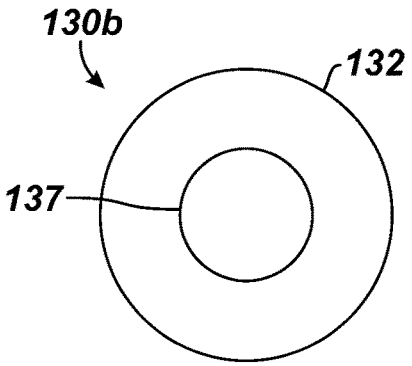
FIGS. 7A-7B illustrate bottom and cross-section views of yet another ceramic insert with a sleeve body having a partial hole.
Figure 7B:
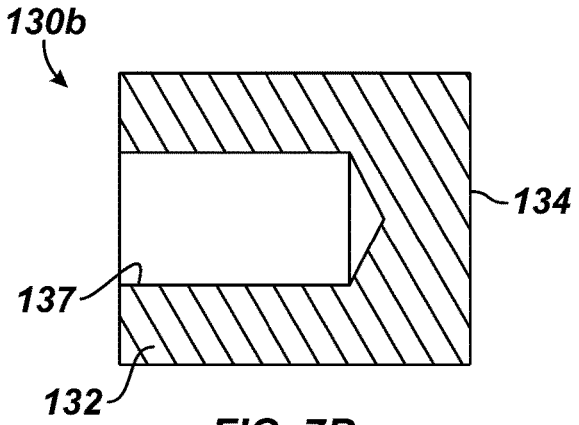

In FIGS. 7A-7B, another insert 130*b* for the first type composed of a ceramic material has a partial cavity, hole, or bore 137 therethrough. For the partial hole 137, the closed end 134 of the sleeve body 132 can be used for the gripping surface of the insert 130 extending beyond the slip's surface (not shown), whereas the open end with the partial hole 137 can be disposed in the slip body (not shown). A reverse arrangement can also be used, with the open end with the hole 137 used for gripping and the closed end 134 disposed in the slip body in which the insert 130 positions.

Figure 8A:
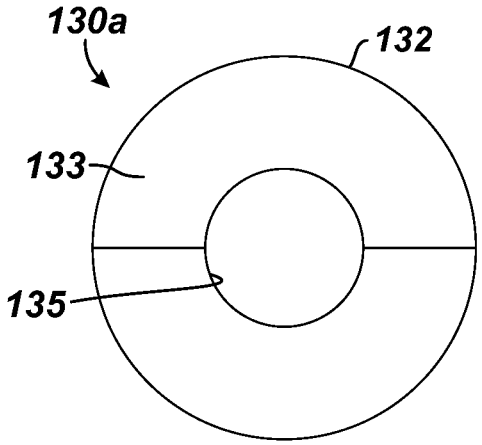
FIGS. 8A-8B illustrate top and cross-section views of another ceramic insert with a pointed body having a full hole.
Figure 8B:
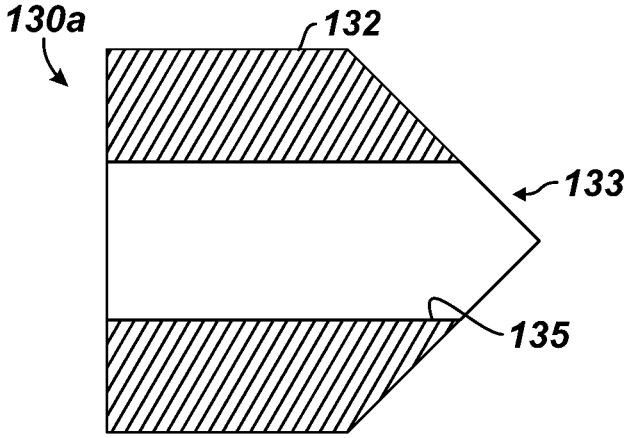
Figure 9A:
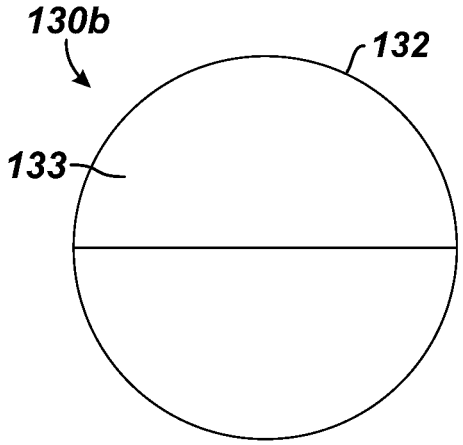
FIGS. 9A-9C illustrate top, cross-section, and perspective views of yet another ceramic insert with a pointed body having a partial hole.
Figure 9B:
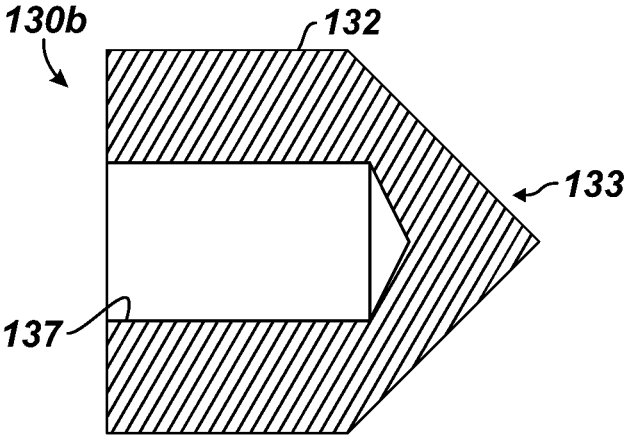
Figure 9C:
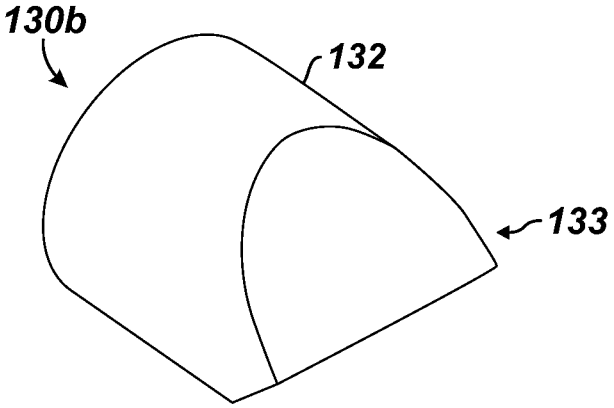

FIGS. 8A-8C show a top and cross-sectional views of another insert 130*a* of the first type having a full hole 135, and FIGS. 9A-9C show top, cross-sectional, and perspective views of another insert 130*b* for the first type having a partial hole 137. Although the inserts 130*a-b* of FIGS. 8A through 9C are generally cylindrical, the top ends 133 of the inserts 130*a-b* are cusped. The insert 130*a-b* can have a diameter of 0.375-in and can have an overall height H2 of about 0.423-in. Leading and tailing sides of the cusped end 133 can be angled at 45-degrees. Other possible configurations for the insert 130*a-b* are disclosed in U.S. Pat. Nos. 9,725,981 and 9,677,356, which are incorporated herein by reference.

These configurations of ceramic inserts 130*a-b* with the full holes 135 or partial holes 137 still provide the necessary gripping. Yet, being composed of ceramic, the insert 130*a-b* with the full or partial hole 135, 137 allows for: (1) breakup of the ceramic insert 130*a-b* more thoroughly into smaller pieces during milling; and (2) less insert material being left in the wellbore per downhole tool (e.g., composite plug) milled up. All of this can save time and money during well operations. For example, less cleanup would be required, and the risk of the BHA (bottom hole assembly) getting stuck in the wellbore from large insert debris would be reduced during milling operations.

The ceramic insert 130*a-b* can use various types of ceramic material, including, but not limited to, alumina, zirconia, cermet, or other ceramic. Preferably, the ceramic material has a density of approximately 3 g/cc. Although reference to density is used in the present disclosure, specific gravity of the ceramic material can be of consideration for use in the wellbore because the wellbore includes drilling fluids. Therefore, including the consideration of density as disclosed, the specific gravity of the various materials disclosed herein may be considered. As is known, specific gravity refers to the density of a material relative to a reference density, such as of drilling fluid or the like in a wellbore application.

Preferably, the ceramic material used for the ceramic inserts 130*a-b* is silicon nitride. Silicon nitride can consist of $Si_3N_4$ and has a density of about 3.3 g/cc. By comparison, zirconium oxide has a density of about 6 g/cc. Based on the general dimensions discussed herein, a ceramic insert of silicon nitride without a hole would have a mass of about 1.83 grams (given a total volume of 0.555 cc for the insert without the hole). For a composite plug having about 48 inserts, the total mass for all of such solid silicon nitride inserts on the entire plug assembly would add up to about 87.8 grams.

However, the inserts 130*a-b* composed of silicon nitride having a full or partial cavity or hole 135, 137 as disclosed herein may have a mass of about 1.38 grams (given a total volume of the 0.418 cc for the insert 130*a-b* with the cavity 135, 137 and given the cavity 135, 137 having a volume of about 0.136 cc). For a composite plug having about 48 inserts, the total mass for all of the hollow silicon nitride inserts 130*a-b* on the entire plug assembly would thereby add up to about 66.2 grams.

In other arrangements, the ceramic material for the ceramic insert 130*a-b* can have a density in a range of about 3 g/cc to about 6 g/cc, such as associated with silicon nitride having a density of about 3.3 g/cc, alumina or aluminum oxide having a density of about 3.95 g/cc, and zirconia or zirconium dioxide having a density of about 5.68 g/cc.

As noted herein, existing inserts are typically composed of a metallic material, such as carbide. Consequently, the existing inserts have a high density (weight) are difficult to circulate out of the wellbore, especially out of a horizontal extended reach well. The hollowed ceramic inserts 130*a-b* of the present disclosure are considerably lighter, making them easier to circulate out and/or easier to break up during milling operations. The hollowed ceramic insert 130*a-b* has a high-strength (high-compression) outer exoskeleton (i.e., sleeve body 132) with a hollow 135 or partially hollow 137 inside diameter.

In this way, the hollow insert 130*a-b* composed of ceramic requires less material to be circulated out of the wellbore after milling, and the insert 130*a-b* are easier to break up into small pieces during milling. Moreover, the lower density ceramic material of the inserts 130*a-b* can make floating/circulating the material to surface easier. This reduces the risks typically encountered when milling up composite plugs.

As noted above with reference to FIG. 4B, the inserts 130*c-d* of the second type can be filled with a filler material. In particular, the disclosed inserts 130*c-d* are composed of ceramic (or even a metallic material) and include an inner filler material in the hollow composed of a low density material. These low density filled inserts 130*c-d* can have any other various shapes disclosed above for the first type of inserts 130*a-b*.

Figure 10A:
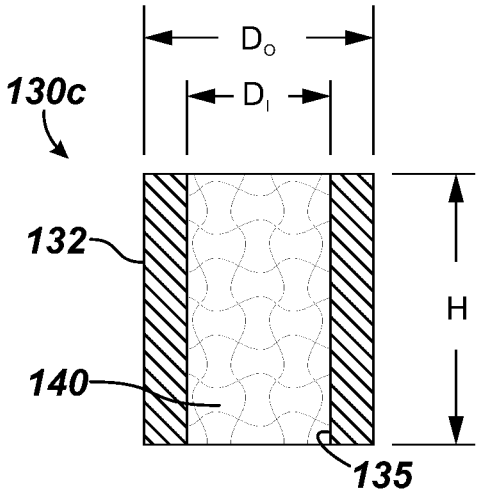
FIGS. 10A-10B illustrate cross-section and perspective section views of a ceramic insert having a full hole filled with a low density material.
Figure 11A:
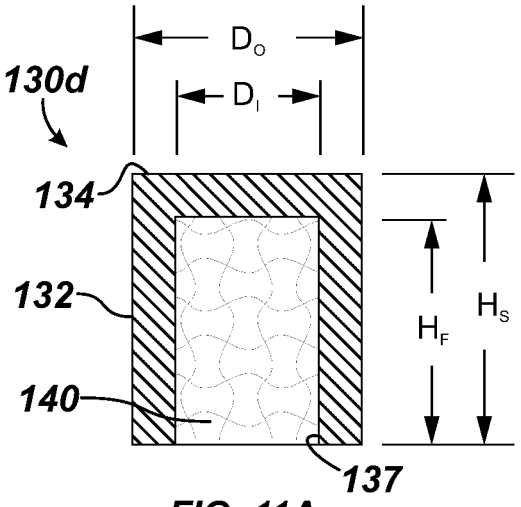
FIGS. 11A-11B illustrate cross-section and perspective section views of a ceramic insert having a partial hole filled with a low density material.
Figure 10B:
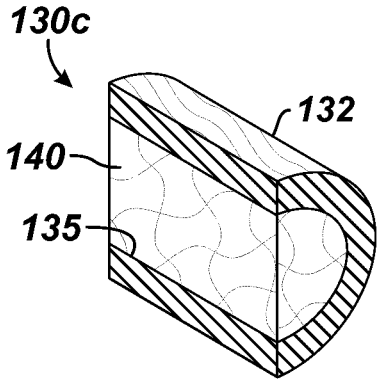
Figure 11B:
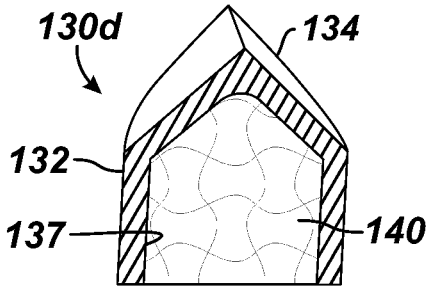
Figure 12A:
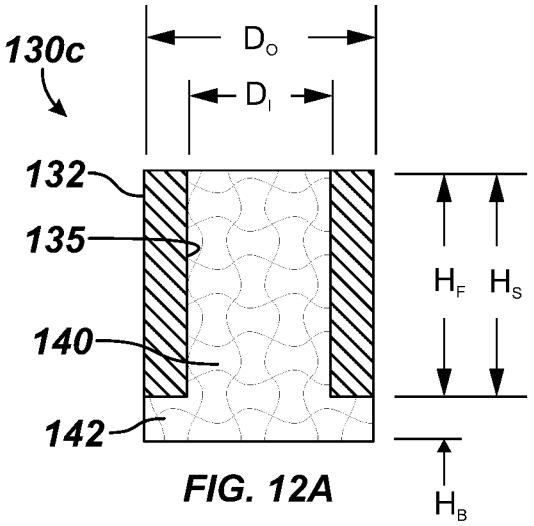
FIGS. 12A-12B illustrate cross-section views of a ceramic insert having additional low density material.
Figure 12B:
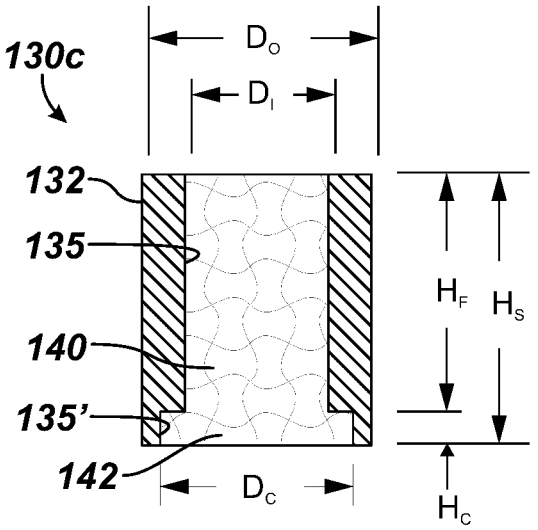

In FIGS. 10A-10B, for example, one insert 130*c* of the second type is a cylindrical sleeve 132 having a full hole 135 filled with a low density filler material 140. In FIGS. 11A-11B, another insert 130*d* of the second type has a partial hole 137 filled with a low density filler material 140. The closed end 134 can be squared off as in FIG. 11A or cusped as in FIG. 11B. FIGS. 12A-12B show additional shapes for the inserts 130*c-d* of the second type and are discussed separately below.

In general, the hollowed insert 130*c-d* has a full cavity, hole or bore 135 or has a partial cavity, hole or bore 137 comparable to the other inserts 130*a-b* discussed above. The filler material 140 disposed in the hole 135, 137 of the insert 130*c-d* can be a material of exceptionally low density and/or can be a dissolvable material.

In one example, the filler material 140 can be an exceptionally low density material, such as an aerogel having a density of about 0.10 to 1.0 g/cc. For example, one type of aerogel includes silica aerogel, which consists of $C_{23}H_{22}N_2O_3S_2$. Other aerogels include carbon aerogels, metal oxide aerogels, and the like Alternatively, the filler material 140 can be a low density metallic or non-metallic material, such as magnesium, aluminum, dissolvable/degradable material, or polyglycolide (PGA).

Overall, the filler material 140 can have a density of at least about 3 g/cc or less, such as associated with aerogel of about 0.1 to 1 g/cc, magnesium of about 1.74 g/cc, polyglycolide (PGA) of about 1.53 g/cc, and aluminum of about 2.70 g/cc.

Overall, the insert material for the exoskeleton or body 132 of these inserts 130*c-d* can have a density of at least about 3 g/cc or greater, such as associated with silicon nitride having a density of about 3.3 g/cc, alumina or aluminum oxide having a density of about 3.95 g/cc, zirconia or zirconium dioxide having a density of about 5.68 g/cc, powdered metal, iron having a density of about 7.86 g/cc, brass having a density of about 8.50 g/cc, cermet having a density of about 6-7.5 g/cc, tungsten carbide density having a density of about 15.25-15.88 g/cc, etc.

Depending on the materials used, the filler material 140 can be manually installed with adhesive or molded in place using a process such as molding, metal injection, powdered metal, or pressing. The outer exoskeleton or body 132 of the insert 130*c-d* can be produced from metallic or non-metallic materials, such as powdered metal, ceramic, or cermet. The outer exoskeleton 132 can also be made of a high strength dissolvable material.

FIGS. 12A-12B illustrate cross-section views of additional arrangements of inserts 130*c* of the second type having low density filler material 140. In FIG. 12A, the filler material 134 may extend beyond the hollow 135 of the insert 130*c* so that a portion of the filler material forms a base 142 that makes up part of the insert 130*c*. This base 142 may have a given height HB, whereas the insert body 132 may have a height HS filled with the rest of the filler 140.

In FIG. 12B, the insert 130*c* of the second type can have an exoskeleton body 132 that is not necessarily uniform as is the sleeve of FIG. 12A. Here, in particular, the bottom end of the insert 130*c* may have a wider hollow or counterbore 135' with a diameter DC and height HC to contain a base 144 of more low-density filler material 140. This bottom end can remain installed in the hole of the slip and allow the body 132 of the insert 130 to use less material.

Although shown with full holes 135, the insert 130*c* in FIGS. 12A-12B could have a partial hole with a closed end opposite the base 142, 144. In fact, any of the variations disclosed in each of FIGS. 12A-12B can be used with the any of the other configurations disclosed herein.

In order for the filled inserts 130*c-d* of FIGS. 10A through 12B to achieve appropriate strength, the shape of the insert 130*c-d*; the inner and outer diameters DI, DO of the sleeve body 132; the heights HF, HS of the sleeve body 132 and the filler 140; the height HC and diameter DC of any counterbore 135'; the height HB of the filler base 142, 142; and the like can be modified based on the strength requirements, the materials used for the sleeve body 132 and filler 140, and the desired implementation.

Overall, the inserts 130*a-d* of FIGS. 6A through 12B can be used on an upper slip assembly 110U only, the lower slip assembly 110D only, or both upper and lower slip assemblies 110U, 110D. Moreover, each of the insert 130*a-d* of FIGS. 6A through 12B can be used in combination with solid inserts as disclosed herein and with any of other inserts 130*a-d* of FIGS. 6A-12 in the same given segment of a slip assembly.

Mass (grams), volume (cubic centimeters), density (grams per cubic centimeters), length (inches), and the like are referenced herein with approximate values, variations, ranges, and the like. As will be appreciated, a value for a given mass, volume, density, length, etc. disclosed herein can vary by a certain percentage thereof (e.g., ±5%), by a certain tolerance thereof (e.g., ±0.1 g, ±0.1 cc, ±0.1 g/cc, ±0.1 in), or by other factor while still achieving the purposes disclosed herein. Therefore, reference to a given mass, volume, density, length, etc. as being "about" a given value, being within a given range, etc. should be constructed to include acceptable variations and tolerances to achieve the purposes disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An insert used on a slip of a downhole tool to engage in a downhole tubular, the insert comprising:

a body defining an internal cavity at least partially therein, the body comprising a ceramic material having a first density of about 3 g/cc to about 6 g/cc, wherein a volume of the insert is about 0.4 cc to about 0.6 cc, and wherein a mass of the insert is about 1.2 g to about 3.6 g.

2. The insert of claim 1, wherein the body comprises:

a first end configured to extend beyond a surface of the slip; and a second end configured to install in the surface of the slip;

wherein at least one of the first and second ends defines an opening to the internal cavity.

3. The insert of claim 1, wherein the ceramic material is selected from the group consisting of silicon nitride, alumina, aluminum oxide density, zirconia, and zirconium dioxide.

4. The insert of claim 1, further comprising a filler disposed in the internal cavity, the filler comprising a second material having a second density at least less than about 3 g/cc.

5. The insert of claim 4, wherein the second material is selected from the group consisting of aerogel, a dissolvable material, polyglycolide, magnesium, and aluminum.

6. An insert used on a slip of a downhole tool to engage in a downhole tubular, the insert comprising:

a body defining an internal cavity at least partially therein and having a first volume, the body comprising a first material having a first density; and a filler disposed in the internal cavity and having a second volume, the filler comprising a second material having a second density less than the first density, wherein a total volume of the insert combining the first and second volumes is about 0.4 cc to about 0.6 cc.

7. The insert of claim 6, wherein the first volume of the body is about 0.4 cc to 0.5 cc, and wherein the second volume of the filler is about 0.1 cc to about 0.2 cc inverse to the first volume.

8. The insert of claim 6, wherein the first density is about 6 g/cc to about 16 g/cc; and wherein the second density is about 0.1 g/cc to about 6 g/cc.

9. The insert of claim 8, wherein the first material is selected from the group consisting of ceramic, zirconia, zirconium dioxide, a metallic material, a non-metallic material, a powdered metal, iron, brass, cermet, and tungsten carbide density.

10. The insert of claim 8, wherein the second material is selected from the group consisting of aerogel, a dissolvable material, polyglycolide, magnesium, aluminum, silicon nitride, alumina, aluminum oxide, zirconia, and zirconium dioxide.

11. The insert of claim 8, wherein a mass of the insert is about 3 g to about 9.2 g.

12. The insert of claim 6, wherein the body defines a bore therethrough as the internal cavity; and wherein:

the filler fills the bore from a first end of the body to a second end of the body; or the filler fills the bore from the first end of the body to below the second end of the body and forms a base of the insert below the second end of the body.

13. The insert of claim 6, wherein the body comprises a first end enclosing the internal cavity and has a second end being open to the internal cavity; and wherein:

the filler fills the internal cavity from the first end to the second end; or the second end defines a counterbore about the internal cavity and the filler fills the counterbore.

14. The insert of claim 6, wherein the first material of the body comprises a silicon nitride with the first density of about 3 g/cc; and wherein second material of the filler has a second density at least less than 3 g/cc.

15. The insert of claim 14, wherein the second material is selected from the group consisting of an aerogel, a dissolvable material, polyglycolide, magnesium, and aluminum.

16. An insert used on a slip of a downhole tool to engage in a downhole tubular, the insert comprising:

a body defining an internal cavity at least partially therein and having a first volume, the body comprising a first material having a first density; and a filler disposed in the internal cavity and having a second volume, the filler comprising a second material having a second density less than the first density, wherein the first material of the body comprises a silicon nitride with the first density of about 3 g/cc; and wherein second material of the filler has a second density at least less than 3 g/cc.

17. The insert of claim 10, wherein a total volume of the insert combining the first and second volumes is about 0.4 cc to about 0.6 cc.

18. The insert of claim 16, wherein the second material is selected from the group consisting of an aerogel, a dissolvable material, polyglycolide, magnesium, and aluminum.

19. The insert of claim 16, wherein the body defines a bore therethrough as the internal cavity; and wherein:

the filler fills the bore from a first end of the body to a second end of the body; or the filler fills the bore from the first end of the body to below the second end of the body and forms a base of the insert below the second end of the body.

20. The insert of claim 16, wherein the body comprises a first end enclosing the internal cavity and has a second end being open to the internal cavity; and wherein:

the filler fills the internal cavity from the first end to the second end; or the second end defines a counterbore about the internal cavity and the filler fills the counterbore.

21. A downhole apparatus for engaging in a downhole tubular, the apparatus comprising:

a mandrel having a first end and a second end;

a sealing element disposed on the mandrel between the first and second ends and compressible to engage the downhole tubular;

a first slip disposed toward the first end of the mandrel and being movable relative to the mandrel to engage the downhole tubular, the first slip having inserts; and a second slip disposed toward the second end of the mandrel and being movable relative to the mandrel to engage the downhole tubular, the second slip having the inserts, wherein one or more of the inserts comprise an insert according to claim 1.

22. A downhole apparatus for engaging in a downhole tubular, the apparatus comprising:

a mandrel having a first end and a second end;

a sealing element disposed on the mandrel between the first and second ends and compressible to engage the downhole tubular;

a first slip disposed toward the first end of the mandrel and being movable relative to the mandrel to engage the downhole tubular, the first slip having inserts; and a second slip disposed toward the second end of the mandrel and being movable relative to the mandrel to engage the downhole tubular, the second slip having the inserts, wherein one or more of the inserts comprise an insert according to claim 6.

23. A downhole apparatus for engaging in a downhole tubular, the apparatus comprising:

a mandrel having a first end and a second end;

a sealing element disposed on the mandrel between the first and second ends and compressible to engage the downhole tubular;

a first slip disposed toward the first end of the mandrel and being movable relative to the mandrel to engage the downhole tubular, the first slip having inserts; and a second slip disposed toward the second end of the mandrel and being movable relative to the mandrel to engage the downhole tubular, the second slip having the inserts, wherein one or more of the inserts comprise an insert according to claim 16.

* * * * *